US006119671A

United States Patent [19]

Smith et al.

[11] Patent Number: 6,119,671

[45] Date of Patent: Sep. 19, 2000

[54] TOY PROJECTILE LAUNCHER

[75] Inventors: Joseph Jay Smith, Cincinnati, Ohio; Bryan R. Keller, Cincinnati, Ill.; Thomas Matthew Walraven, Jacksonville, Fla.

[73] Assignee: Johnson Research & Development Company, Inc., Smyrna, Ga.

[21] Appl. No.: 09/172,572

[22] Filed: Oct. 14, 1998

[51] Int. Cl.[7] ..... F41B 11/28; F41B 11/32

[52] U.S. Cl. ..... 124/59; 124/75

[58] Field of Search ..... 124/59, 69, 73, 124/74, 75, 66

[56] References Cited

U.S. PATENT DOCUMENTS

| | | | |
|---|---|---|---|
| D. 159,040 | 6/1950 | Bicos | D30/1 |
| D. 337,796 | 7/1993 | Sutyak | D21/145 |
| D. 355,224 | 2/1995 | Arad et al. | D21/145 |
| 786,426 | 4/1905 | Daniels . | |
| 2,117,935 | 5/1938 | Benjamin et al. . | |
| 2,505,428 | 4/1950 | Pope . | |
| 2,630,108 | 3/1953 | White . | |
| 2,725,868 | 12/1955 | Foster . | |
| 2,725,869 | 12/1955 | Barber . | |
| 2,733,699 | 2/1956 | Krinsky . | |
| 2,991,782 | 7/1961 | Ayala . | |
| 3,262,440 | 7/1966 | Kuhn . | |
| 3,271,033 | 9/1966 | Parker | 273/101 |
| 3,445,069 | 5/1969 | Druge | 239/407 |
| 3,465,744 | 9/1969 | Nielsen | 124/27 |
| 3,709,495 | 1/1973 | Krombein | 124/27 |
| 3,739,764 | 6/1973 | Allport . | |
| 3,765,396 | 10/1973 | Kienholz et al. . | |
| 3,788,298 | 1/1974 | Hale . | |
| 3,869,825 | 3/1975 | Heberlein . | |
| 4,067,309 | 1/1978 | Wohrstein | 124/67 |
| 4,159,705 | 7/1979 | Jacoby | 124/63 |
| 4,559,737 | 12/1985 | Washington | 43/59 |
| 5,205,271 | 4/1993 | Casas Salva | 124/66 |
| 5,242,323 | 9/1993 | Rappaport | 446/180 |
| 5,267,549 | 12/1993 | Webber | 124/65 |
| 5,343,850 | 9/1994 | Steer | 124/73 X |
| 5,404,863 | 4/1995 | Poor | 124/74 |
| 5,515,837 | 5/1996 | Nin et al. | 124/59 |
| 5,529,050 | 6/1996 | D'Andrade | 124/73 X |
| 5,553,598 | 9/1996 | Johnson et al. | 124/63 |
| 5,558,324 | 9/1996 | Jourdan | 273/260 |
| 5,626,123 | 5/1997 | Johnson et al. | 124/69 |
| 5,715,802 | 2/1998 | Moore et al. | 124/66 |
| 5,878,734 | 3/1999 | Johnson et al. | 124/59 |

*Primary Examiner*—Robert P. Swiatek
*Attorney, Agent, or Firm*—Kennedy, Davis & Hodge, LLP

[57] ABSTRACT

A toy projectile launcher in the form of a toy gun has a first and second barrel. The second barrel is pivotably mounted to a housing for movement from a first position to a second position in which the second barrel is axially aligned with the first barrel for firing a projectile from the second barrel.

20 Claims, 3 Drawing Sheets

TOY PROJECTILE LAUNCHER

FIELD OF THE INVENTION

The present invention relates generally to toy projectile launchers, and more particularly, the present invention relates to a toy projectile launcher having a pivotably mounted second barrel that is axially alignable with a first barrel.

BACKGROUND OF THE INVENTION

Toy projectile launchers are well known and have employed numerous arrangements to apply a launching force to a projectile. For example, spring mechanisms have been frequently used to provide the launching force. More recently, compressed air has been used for providing the launching force. An arrangement using compressed air is shown in commonly assigned U.S. Pat. No. 5,701,878, and additional arrangements using compressed air are shown in U.S. Pat. Nos. 5,626,123 and 5,709,199.

It is also desirable to provide an ability to launch multiple projectiles without having to reload projectiles into the launcher. In this regard, the '199 patent mentioned above provides a multi-barrel arrangement in which each barrel indexes to a firing position for launching a projectile therefrom.

SUMMARY OF THE INVENTION

The present invention provides a toy projectile launcher in the form of a toy gun having a first and second barrel each arranged to receive a projectile for launching therefrom. The second barrel is pivotably mounted adjacent the first barrel for movement from a first position to a second position in which the second barrel is axially aligned with the first barrel for firing a projectile from the second barrel.

In a further embodiment of the present invention, a spring is provided coupled between the first and second barrels to urge the second barrel from the first position to the second position. A latch is provided for retaining the second barrel in the first position and a trigger is provided for releasing the latch and thus allowing the second barrel to pivot into the second, launching position upon the urging of the spring.

Still further, the toy gun may be equipped with a launching chamber into which pressurized air is introduced. Discharge of the pressurized air through the first barrel causes the launching of a projectile from the first barrel. In addition, with the second barrel in the second position, the discharge of air through the first barrel further causes the launching of a projectile from the second barrel.

In still a further preferred arrangement of the present invention, a triggering chamber is coupled to the launching chamber. The pressurized air is introduced into each of the triggering chamber and the launching chamber in order to ready the toy for launching a projectile. The triggering chamber is coupled to a trigger. Actuation of the trigger causes a discharge of air from the triggering chamber further causing a discharge of pressurized air from the launching chamber through the first barrel, and thus, launching a projectile from the first barrel when the second barrel is in the first position or from the second barrel when the second barrel is in the second position.

These and other features and advantages of the present invention will become apparent to one of ordinary skill in the art in view of the following description of preferred embodiments and with reference to the attached drawings.

DETAILED DESCRIPTION OF THE PREFERRED EMBODIMENTS

Figure 1:
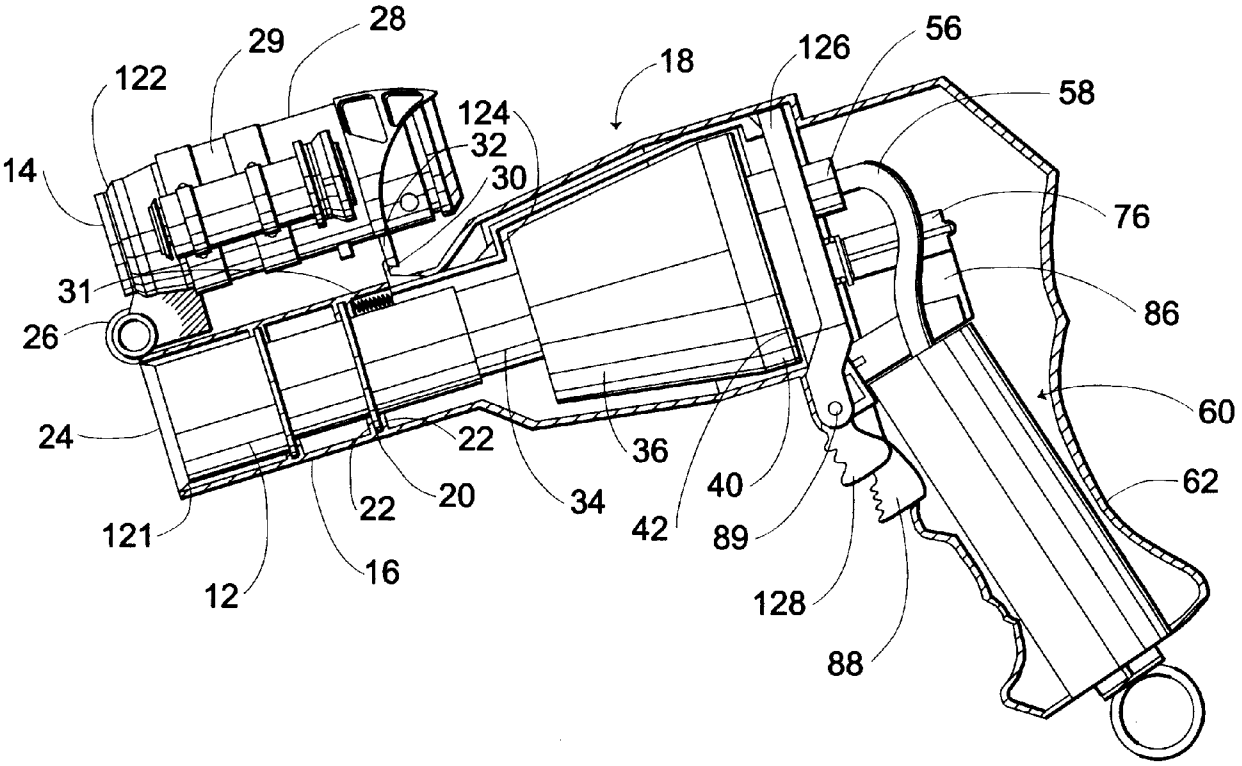
FIG. 1 is a left side elevation view of a toy projectile launcher in accordance with a preferred embodiment of the present invention and with a portion of the housing removed.
Figure 2:
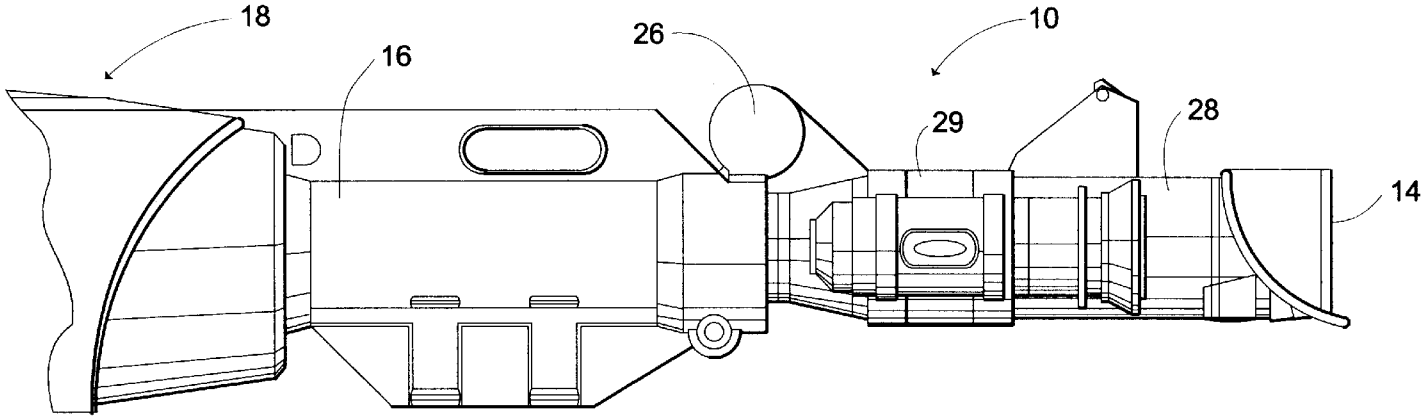
FIG. 2 is a partial left side elevation view of the toy projectile launcher shown in FIG. 1 with the second barrel in its second position.

With reference to FIG. 1 and FIG. 2, a toy projectile launcher 10 includes a first projectile launching barrel 12 and a second projectile launching barrel 14. First barrel 12 is retained within a barrel portion 16 of a housing 18. Housing 18 is preferably formed from a suitable plastic material such as super high impact polystyrene as a pair of substantially symmetrical halves configured with the general appearance of a gun. The halves are then joined together by, for example, threaded fasteners, staking, bonding, sonic welding and the like. To assist in viewing the invention only a first half of housing 18 is shown in FIG. 1, with the second half being removed for clarity. First barrel 12 includes one or more radially extending ribs 20 that engage ribs 22 formed in barrel portion 16 to retain barrel 12 within housing 18. A muzzle end 24 of first barrel 12 is adapted to receive a foam dart projectile 19 for launching from first barrel 12.

Second barrel 14 is secured within a barrel housing 28. Barrel housing 28 is configured with an outer surface 29 to appear substantially as a scope-type gun sight that might be fixedly secured to barrel portion 16. However, barrel housing 28 is pivotably mounted via hinge 26 to housing 18. Second barrel 14 is retained in a first position by a latch 30 slidingly secured within housing 18 engaging a notch 32 formed in barrel housing 28. Latch 30 is held into engagement with notch 32 by spring 31.

The first position of second barrel 14 is shown in FIG. 1. Second barrel 14 may be pivoted upon release of latch 30 to a second position in which it is axially aligned with first barrel 12, appearing as an extension thereof. The second position for second barrel 14 is shown in FIG. 2. As will be described more fully below, second barrel 14 is fully operable to launch a projectile when in the second position.

Figure 3:
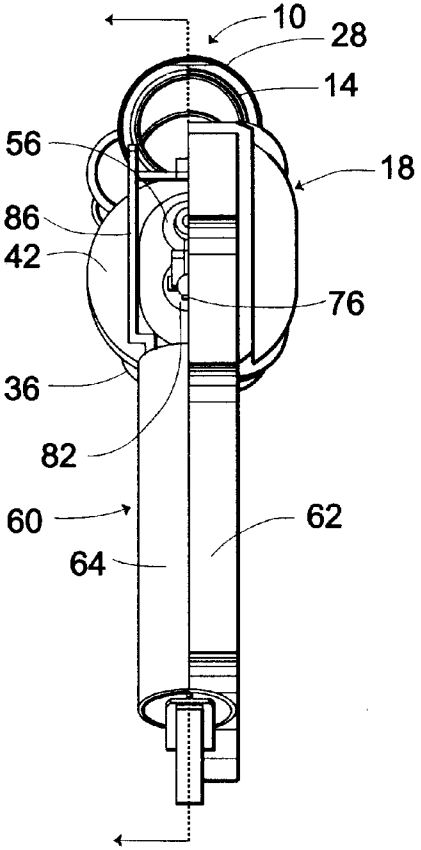
FIG. 3 is a rear elevation view of the toy projectile launcher shown in FIG. 1.
Figure 5:
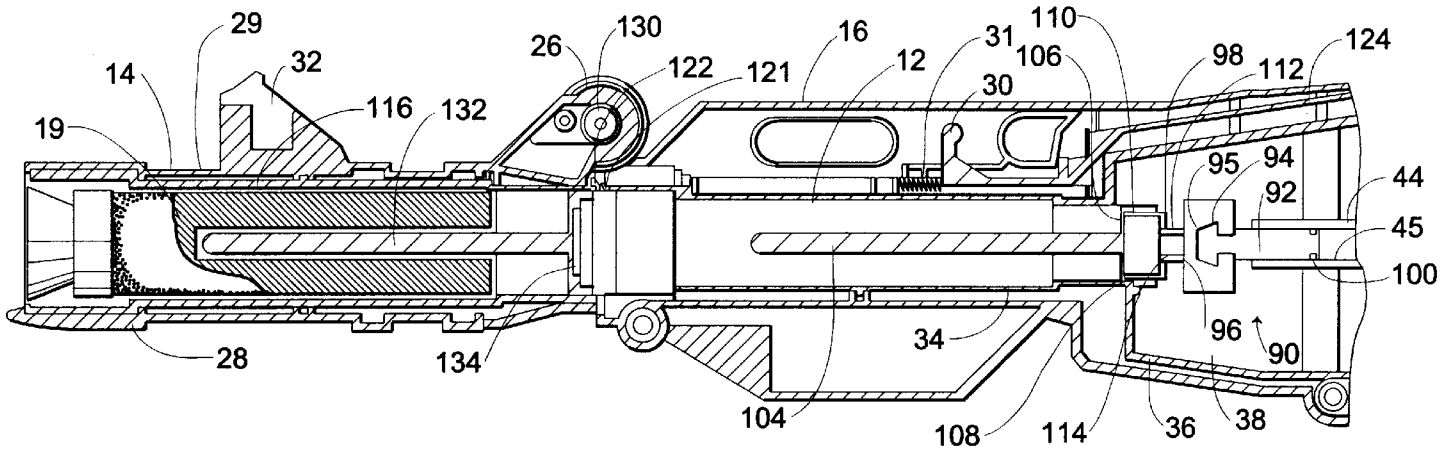
FIG. 5 is a partial cross-section view taken along line 4—4 of FIG. 3 and illustrating the second barrel in its second position.
Figure 4:
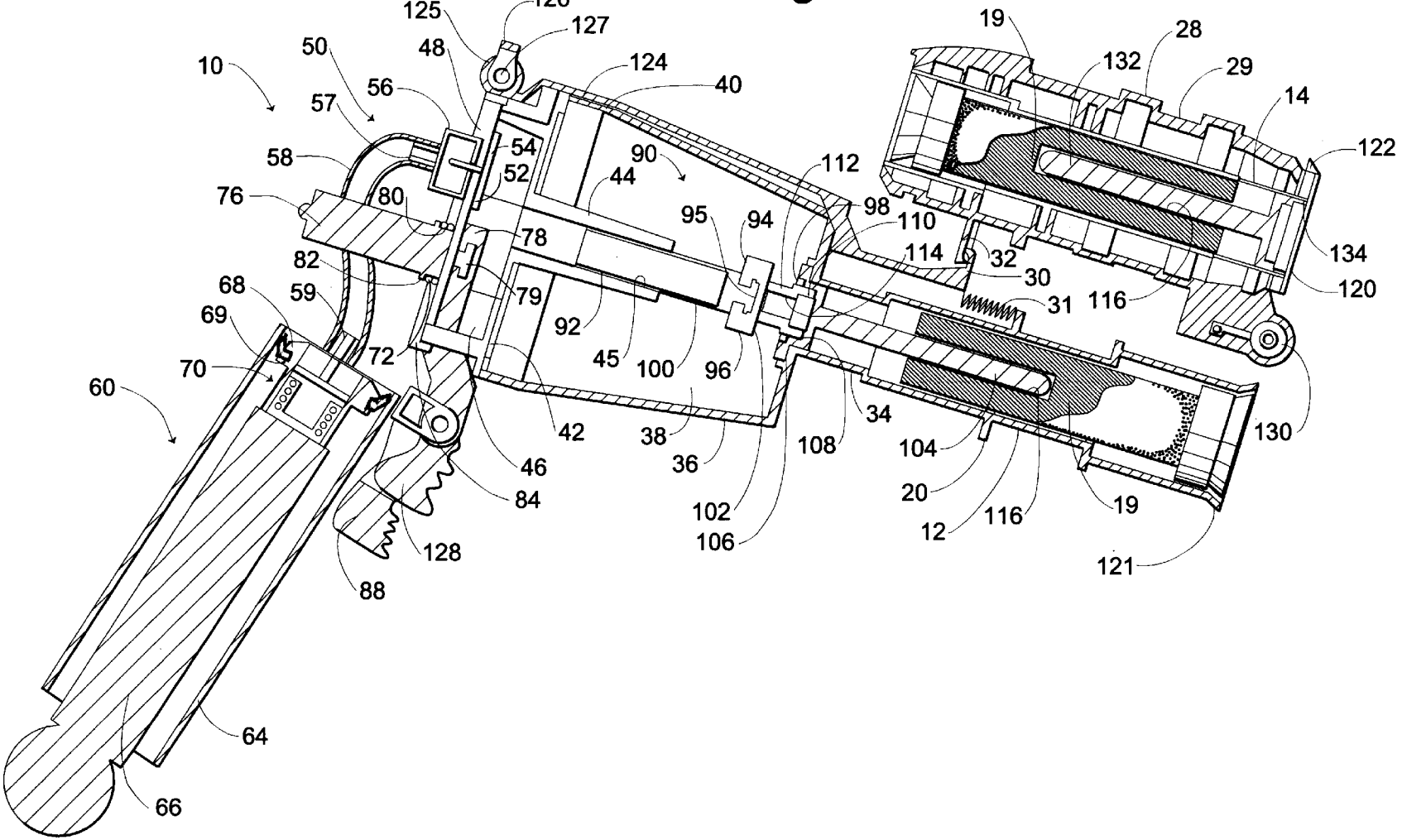
FIG. 4 is a cross-section view taken along line 4—4 of FIG. 3.

Referring now to FIGS. 3–5, the structure of toy projectile launcher 10 will be described in more detail. As noted, first barrel 12 is secured within housing 18. A breech end 34 of first barrel 12 is formed integral to a generally cylindrical portion 36. Cylindrical portion 36 extends axially with first barrel 12 and defines a launching pressure chamber 38. Cylindrical portion 36 is enclosed at a second end 40 by an enclosure 42. Enclosure 42 includes a cylindrical portion 44 extending axially with first barrel 12 into launching pressure chamber 38. A triggering chamber 46 is formed in a surface of enclosure 42 opposite launching chamber. Triggering chamber 46 is enclosed by end cap 48.

End cap 48 includes a flapper valve assembly 50 including a flapper valve 52 disposed within an aperture 54 formed in end cap 48. Flapper valve 52 is a one-way valve as is very well-known in the art permitting the introduction of pressurized fluid into triggering chamber 46 and inhibiting the outflow of pressurized fluid from triggering chamber 46. Flapper valve assembly 50 further includes, disposed on an opposite side of end cap 48, a flapper valve housing 56 including a fitting 57 for coupling to a hose 58. Hose 58 is coupled at a second to a fitting 59 formed on a pump assembly 60 disposed within a grip portion 62 of housing 18.

Pump assembly 60 is constructed in accordance with known principles and includes a pump housing 64, a plunger 66 axially slidable within pump housing 64 and a pump seal 68 secured to an end 69 of plunger 66. Pump seal 68 acts on a pressure stroke to direct pressurized fluid, for example, compressed air, compressed air and water, compressed gas and the like, through hose 58 into triggering chamber 46, and on a inlet stroke to permit fluid to enter pump housing 64. Pump assembly 60 further includes disposed at an end of plunger 66 a pressure release valve assembly 70, such as a spring biased pressure valve, as is also known in the art. It should be noted that while a manually operated pump has been shown for a source of pressurized fluid, other sources of pressurized fluid, such as canisters of compressed gas, electrically driven pumps, and the like may be utilized without departing from the fair scope of the present invention. The manual pump offers a relatively simple device that is capable of achieving a level of pressurized air sufficient for launching projectiles.

Received through an aperture 72 also formed in end cap 48 is a triggering valve 74 including a valve stem 76 and a valve seal 78 secured to a button 79 formed on an end of valve stem 76. Triggering valve 74 is further biased in a first, closed position, as shown in FIG. 4, by spring 80 bearing between a flange 82 formed on valve stem 76 and end cap 48. In the first position, valve seal 78 seals to a valve seat surface portion 84 of end cap 48 adjacent aperture 72 substantially sealing triggering chamber 46 from the atmosphere. Valve stem 76 is further formed with a pin (not depicted) that couples to an arm portion 86 of a launch trigger 88 pivotably mounted within housing 18 (best seen in FIG. 1) on pin 89. Triggering valve 74 is movable between a first position (as shown in FIG. 4) to a second position in which valve seal 78 disengages from valve seat 84 permitting fluid flow between triggering pressure chamber 48 and the atmosphere. Valve stem 76 has a cross configuration to reduce any obstruction of the fluid flow from triggering chamber 46 through aperture 72.

A launch valve assembly 90 is axially received and slidable within cylinder portion 44. Launch valve assembly 90 includes a plunger 92 having a button 95 formed at an end thereof onto which a seal 94 is secured. Plunger 92 is shown as a cylinder with an enclosed first end; however, a solid cylinder (as shown, for example, in FIG. 5 and designated 92') or a cylinder with two enclosed ends may be used to reduce the volume of triggering chamber 46. Plunger 92 is slidable within cylinder portion 44 in response to the introduction of pressurized fluid into triggering chamber 46. That is, when pressurized fluid, i.e., pressurized air from pump assembly 60, is introduced into triggering chamber 46, valve assembly 90 is urged by the pressurized fluid to a first, extended position. In the extended position seal 94 bears against and seals to a seal surface 96 formed on a nozzle 98 disposed within launching pressure chamber 38 and coupling to first barrel 12 sealing launching pressure chamber 38 from barrel 12. While shown line-to-line in FIG. 4, a small clearance on the order of 0.005–0.010 inch exists between an outer wall 100 of plunger portion 92 and an interior wall 45 of cylinder portion 44. This small clearance permits pressurized fluid to flow past plunger portion 92 and into launching pressure chamber 38. Continued introduction of pressurized fluid into triggering pressure chamber 46 therefore further causes launching pressure chamber to become pressurized and each to obtain a substantially equalized pressurized state.

With triggering chamber 46 and launching pressure chamber 38 pressurized, actuation of trigger 88 causes triggering valve assembly 74 to move to its second position and seal 78 to disengage from seat 84. This results in a discharge of pressurized fluid from triggering chamber 46 to atmosphere. As the pressures in triggering chamber 46 and launching pressure chamber 38 become unequalized, a pressure differential is created between launching pressure chamber 38 and triggering chamber 46. A force is caused to bear against a surface 102 of seal 94 axially moving launching valve assembly 90 to a second, recessed position within cylinder portion 44. With launching valve assembly 90 in the second position, seal 94 disengages from sealing surface 96, and pressurized fluid within launching pressure chamber 38 is discharged therefrom through nozzle 98, into first barrel 12.

Disposed within first barrel 12 is a launch tip 104. Launch tip 104 includes a flange portion 106 which is secured within the internal diameter of barrel 12 adjacent breech end 34. Launch tip 104 is substantially axially aligned with barrel 12 and extends for approximately one-half to three-quarters its length. Flange 106 is further formed to include a recessed portion 108 into which nozzle 98 is secured. Nozzle 98 includes a cylindrical portion 110 adapted to engage and secure to recessed portion 108. Nozzle 98 further includes a nipple portion 112 extending into launching pressure chamber 38 and including sealing surface 96 on an end thereof Nozzle 98 is formed with a through aperture 114 and flange 106 includes a plurality of apertures (not depicted) which together place barrel 12 in fluid communication with launching pressure chamber 38. Launch tip 104 directs the discharge of pressurized fluid from launching pressure chamber 38 into a cavity 116 formed in projectile 19 so that the launching force exerted by the discharge of pressurized fluid is substantially uniformly distributed to projectile 19. Launch tip 104 may also be formed with an axially extending aperture for further directing pressurized fluid into cavity 116. This feature of launch tip 104 and of projectile 19 is more fully described in the aforementioned commonly-assigned U.S. Pat. No. 5,701,878, the disclosure of which is hereby expressly incorporated herein by reference. Still, a further function and feature of launch tip 104 is to inhibit the introduction of improvised projectiles or other foreign objects into first barrel 12.

As noted, second barrel 14 is pivotable about hinge 26 from a first position shown in FIG. 4 to a second position, shown in FIG. 5, wherein second barrel 14 is axially aligned with first barrel 12. In this regard, in the second position a breech end 118 of second barrel 14 is disposed adjacent muzzle end 24 of first barrel 12. In a preferred embodiment, a seal 122 is provided adjacent breech end 120 and engages a flared portion 121 of barrel portion 16 adjacent muzzle end 24 for sealing second barrel 14 to first barrel 12.

Second barrel 14 is retained in the first position by the engagement of a latch 30 with a notch 32 formed in housing 28. Latch 30 is coupled to a latch actuator 124 which extends within housing 18 around cylindrical portion 36. An arm 126 is formed integral to a barrel release trigger 128 which is also pivotably mounted on pin 89. Arm 126 includes a pin 127 formed at a distal end that engages a c-snap member 125 formed on latch actuator 124. Applying pressure to release trigger 128 causes arm 126 to bear against latch actuator 124 which, in turn, translates with respect to notch 32 thereby releasing latch 30 from notch 32. With latch 30 released, second barrel 14 is free to pivot, under the urging of spring 130, to its second position (shown in FIG. 5). In the second position, second barrel 14 is ready for launching a projectile therefrom. Second barrel 14 is fitted with a launch tip 134 which is of similar construction as launch tip 104. Launch tip 132 includes a flange 134 that engages the internal diameter of second barrel 14 for retaining launch tip 132 therein. Flange 134 is further formed with a plurality of apertures (not depicted) for permitting substantially unobstructed fluid flow from first barrel 12 into second barrel 14. In this manner, launching chamber is coupled, via first barrel 12, to second barrel 14 for launching projectiles therefrom.

In operation, projectile 19 may be positioned within each of first barrel 12 and second barrel 14. Pump assembly 60 is actuated to bring both triggering chamber 46 and launching pressure chamber 38 to the pressurized state. The projectile in first barrel 12 is launched by applying pressure to trigger 88 and discharging pressurized gas from launching pressure chamber 38 into first barrel 12 as described above.

Without reloading first barrel 12, pump assembly 60 is again used to bring triggering chamber 46 and launching pressure chamber 38 to the pressurized state. From the appearance of toy projectile launcher 10, an opponent will be unaware that a second projectile is available for launch. Applying pressure to release trigger 128 releases latch 30 from notch 32 and second barrel is pivoted into its second position through action of spring 130. A flange 131 is formed on barrel portion 16 that engages seal 122 to assist in retaining second barrel 14 in the second position. Applying pressure again to trigger 88 causes a discharge of pressurized gas from launching pressure chamber 38 into first barrel 12. The pressurized fluid is coupled from first barrel 12 into second barrel 14 for applying a launching force to the projectile contained therein.

While described in terms of several preferred embodiments, one of ordinary skill in the art will appreciate that the present invention may be adapted to a wide variety of applications. Moreover, various enhancements and modifications may be made to the embodiments described herein without departing from the fair scope of the present invention. Several such enhancements and modifications are discussed above, while others will become apparent from the foregoing description, the attached drawings and the subjoined claims.

We claim:

1. A toy projectile launcher comprising:

a first barrel adapted to receive a first projectile for launching therefrom;

a second barrel adapted to receive a second projectile for launching therefrom, the second barrel pivotably mounted adjacent to the first barrel for movement between a first position and a second position in which the second barrel is axially aligned with the first barrel;

a launching mechanism coupled to the first barrel, and with the second barrel in the second position, to the second barrel via the first barrel, the launching mechanism adapted to provide a projectile launching force to the first projectile with the second barrel in the first position and to the second projectile with the second barrel in the second position; and a trigger coupled to actuate the launching mechanism.

2. The toy projectile launcher of claim 1, wherein in the second position a breech end of the second barrel is disposed adjacent to a muzzle end of the first barrel.

3. The toy projectile launcher of claim 1, further comprising a spring coupled between the first barrel and the second barrel to urge the second barrel from the first position to the second position, a latch moveable between a first position in which it couples to and retains the second barrel in the first position and a second position in which it is released from the second barrel, and a release trigger coupled to urge the latch from the first position to the second position.

4. The toy projectile launcher of claim 1, the launching mechanism comprising a launching chamber coupled to a breech end of the first barrel and to the trigger.

5. The toy projectile launcher of claim 4, the trigger comprising a triggering chamber coupled to the launching chamber and the trigger.

6. The toy projectile launcher of claim 5, the trigger further comprising a triggering valve having a first position substantially sealing the triggering chamber from the atmosphere and a second position coupling the triggering chamber to the atmosphere.

7. The toy projectile launcher of claim 6, the launching chamber further comprising a launching valve having a first position substantially sealing the launching chamber from the first barrel and a second position coupling the launching chamber to the first barrel, the launching valve responsive to a pressurized state of the triggering chamber.

8. The toy projectile launcher of claim 1, wherein in the first position the second barrel is substantially parallel to the first barrel and resembles a sight.

9. A toy projectile launcher comprising:

a first barrel adapted to received a first projectile;

a second barrel adapted to receive a second projectile and pivotably mounted adjacent to the first barrel for movement between a first position and a second position in which the second barrel is axially aligned with the first barrel;

each of the first barrel and the second barrel adapted to discharge the first projectile and the second projectile, respectively, responsive to a flow of pressurized fluid;

a launching chamber containing a pressurized fluid, the launching chamber coupled by a launching valve to the first barrel, and with the second barrel in the second position, to the second barrel via the first barrel; and a trigger coupled to the launching valve for selectively discharging the pressurized fluid from the launching chamber into the first barrel for launching the first projectile with the second barrel in the first position and the second projectile with the second barrel in the second position.

10. The toy projectile launcher of claim 9, further comprising a pump coupled to the launching chamber to supply the pressurized fluid into the launching chamber.

11. The toy projectile launcher of claim 10, the trigger comprising:

a triggering chamber coupled to the launching chamber and pressurized with the pressurized fluid supplied by the pump to a substantially equalized pressure state with the launching chamber, the trigger further coupled to the launching valve, and the launching valve responsive to a pressure change within the triggering chamber to discharge the pressurized fluid from the launching chamber into the first barrel.

12. The toy projectile launcher of claim 11, wherein the launching valve is disposed within the launching chamber and moveable between a first position substantially sealing the launching chamber from the first barrel and a second position coupling the launching chamber to the first barrel, the launching valve responsive to the pressure change to move from the first position to the second position.

13. The toy projectile launcher of claim 12, the launching valve further comprising a passage coupling the launching chamber and the triggering chamber.

14. The toy projectile launcher of claim 12, the trigger further comprising a triggering valve having a first position substantially sealing the triggering chamber from the atmosphere and a second position coupling the triggering chamber to the atmosphere.

15. The toy projectile launcher of claim 9, further comprising a spring coupled between the first barrel and the second barrel to urge the second barrel from the first position to the second position, a latch moveable between a first position in which it couples to and retains the second barrel in the first position and a second position in which it is released from the second barrel, and a release trigger coupled to urge the latch from the first position to the second position.

16. The toy projectile launcher of claim 9, wherein in the first position the second barrel is disposed above and substantially parallel to the first barrel and resembles a sight.

17. A toy projectile launcher comprising:

a housing;

a first barrel adapted to receive a first projectile for launching therefrom, the first barrel secured within the housing and coupled to a projectile launching mechanism;

a second barrel adapted to receive a second projectile for launching therefrom, the second barrel secured within a second barrel housing, the second barrel housing being pivotably mounted to the housing for movement between a first position and a second position, wherein in the second position the second barrel is substantially axially aligned with the first barrel and is coupled to the projectile launching mechanism via the first barrel, and the launching mechanism comprising a launching chamber and a triggering chamber each containing pressurized fluid, the launching chamber coupled by a launching valve to the first barrel, the launching valve arranged, in a first position, to discharge pressurized fluid from the launching chamber into the first barrel and, in a second position, to inhibit the discharge of pressurized fluid from the launching chamber into the first barrel;

the triggering chamber coupled by a triggering valve to the atmosphere, the triggering valve in a first position, sealing the triggering chamber from the atmosphere, and in a second position, discharging the pressurized fluid from the triggering chamber to the atmosphere;

the pressurized fluid within the triggering chamber urging the launching valve to its first position and the pressurized fluid in the launching chamber urging the launching valve to its second position upon the discharge of the pressurized fluid from the triggering chamber to the atmosphere; and a trigger member coupled to the triggering valve for moving the triggering valve between its first and its second position.

18. The toy projectile launcher of claim 17, further comprising a pump to provide pressurized fluid to each of the launching chamber and the triggering chamber.

19. The toy projectile launcher of claim 17, wherein in the first position the second barrel is disposed above and substantially parallel to the first barrel and resembles a sight.

20. The toy projectile launcher of claim 17, further comprising a spring coupled between the housing and the second barrel housing to urge the second barrel from the first position to the second position, a latch moveable between a first position in which it couples to and retains the second barrel in the first position and a second position in which it is released from the second barrel, and a release trigger coupled to urge the latch from the first position to the second position.

* * * * *